United States Patent [19]

Bovone

[11] Patent Number: 4,493,167

[45] Date of Patent: Jan. 15, 1985

[54] CHAMFERING MACHINES, PARTICULARLY FOR GLASS SHEETS

[76] Inventor: Luigi Bovone, Regione Pernigotti, 15070 Belforte Monferrato (Alessandria), Italy

[21] Appl. No.: 619,838

[22] Filed: Jun. 12, 1984

Related U.S. Application Data

[63] Continuation of Ser. No. 384,682, Jun. 3, 1982, abandoned.

[30] Foreign Application Priority Data

Jun. 11, 1981 [IT] Italy ..... 22248 A/81

[51] Int. Cl.[3] ..... B24B 9/10

[52] U.S. Cl. ..... 51/110; 51/215 E; 51/283 E; 198/627; 409/161; 144/245 A

[58] Field of Search ..... 51/38, 74 R, 76 R, 76 BS, 51/78, 110, 112, 137, 138, 139, 215 E, 215 M, 283 E; 409/161, 173; 144/242 R, 245 A; 198/627

[56] References Cited

U.S. PATENT DOCUMENTS

| | | | |
|---|---|---|---|
| Re. 29,097 | 1/1977 | Bando | 51/110 |
| 1,728,647 | 9/1929 | Weber | 51/110 |
| 3,103,694 | 9/1963 | Zebarth et al. | 198/627 X |
| 4,079,551 | 3/1978 | Bando | 51/110 |
| 4,364,696 | 12/1982 | Syarto et al. | 144/245 A X |

FOREIGN PATENT DOCUMENTS

| | | | |
|---|---|---|---|
| 840066 | 7/1960 | Fed. Rep. of Germany | 51/110 |
| 2537879 | 11/1976 | Fed. Rep. of Germany | 51/110 |

*Primary Examiner*—Robert P. Olszewski

[57] ABSTRACT

In belt chamfering machines, the glass sheet being machined is gripped and conveyed during the machining (chamfering) of its edge between two facing portions of two belts. The rear belt extends downwards more than the front belt as it has to provide a support for the sheet at or in proximity to the edge being machined. Small sheets cannot be machined by known machines of this type because they would not be adequately gripped between the two belts. To obviate this drawback, the invention provides for the rear belt to be able to be adjusted in height so as to vary the downward projection of said belt relative to the front belt. At the same time, the position of the conveyors on which the sheets rest before and after machining can be adjusted to the same degree.

4 Claims, 6 Drawing Figures

CHAMFERING MACHINES, PARTICULARLY FOR GLASS SHEETS

This is a continuation of co-pending application Ser. No. 384,682 filed June 3, 1982, now abandoned.

DESCRIPTION

The invention relates to improvements in chamfering machines, particularly for glass sheets, where said machines are of the type comprising a pair of belts of vertical or nearly vertical axis of rotation which grip and convey the sheet along a set of motor-driven tools which machine, i.e. chamfer, the edge of the sheet.

In conventional machines of this type, the rear belt extends downward beyond the front belt because it has to provide a support for the edge of the sheet on the opposite face which is being machined (i.e. chamfered). The extent of this projection is fixed in these machines, and is related on the one hand to the dimensions of the sheets to be machined and on the other hand to the maximum height of the edge to be machined. As these machines are designed to machine sheets of a certain size, they are unsuitable for machining small dimension sheets, for example having sides of less than 10 cm, because the two belts would not be able to retain such sheets either sufficiently or at all, and because the sheet feed and unloading devices would not be usable.

A known machine of this type is for example described in French Pat. No. 2282972, and its sheet feed and unloading devices are described in Italian utility model application No. 22164 B/74 of Oct. 16, 1974, to which reference should be made for further details.

The object of the present invention is to improve a chamfering machine of the aforesaid type such that it is able to machine glass sheets of both large and small dimensions by means of adjustment operations which are easy and rapid to carry out.

This and further objects which will be more apparent from the detailed description given hereinafter are attained by the improvements of the invention, which provide for the rear belt to be adjustable in height so as to vary its downward projection relative to the front belt.

According to a preferred aspect of the invention, the sheet feed and unloading devices are connected to the rear belt so that they undergo corresponding movements.

BRIEF DESCRIPTION OF THE DRAWINGS

The invention will be more apparent from the detailed description of a preferred embodiment given by way of non-limiting example hereinafter with reference to the accompanying drawing, in which.

DETAILED DESCRIPTION OF THE PREFERRED EMBODIMENT

Figure 1:
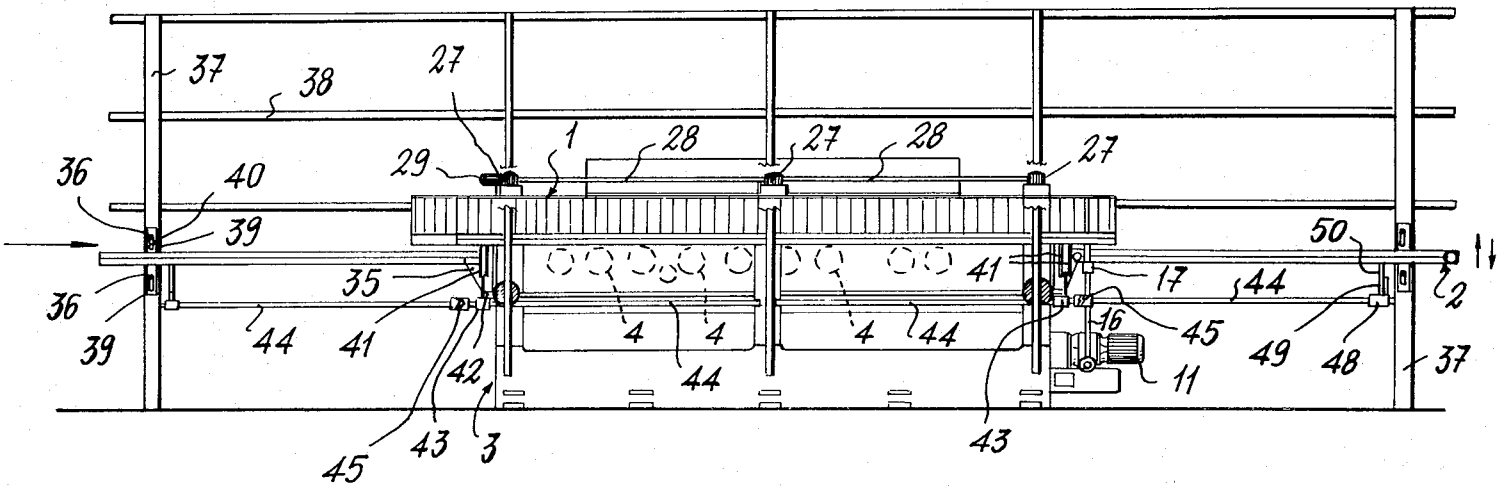
FIG. 1 is a diagrammatic rear elevation of the machine according to the invention.

With reference to the figures, the chamfering machine illustrated corresponds generally to the type described in the aforesaid patent publications, but with the important difference that the rear belt 13 is in this case adjustable in height and the mobile support surfaces of the sheet feed and unloading devices (surfaces provided by conveyor belts 2) are also correspondingly adjustable in height.

As described in said patent, the machine bed 3 supports a beam which is inclinable and mobile transversely to itselt and carries a set of operating assemblies 4 comprising for example a tool 5 (i.e. a griding wheel, a buffing disc etc.) and an electric motor-driven spindle 6. The bed 3 also carries a front belt 7 formed from a set of elements 8 hinged together and guided by rollers 9 on guide surfaces of the bed. At each end where the belts turns round, the horizontal rollers engage with pairs of parallel coaxial toothed wheels 10. One of these pairs is driven by a geared motor 11 by way of usual transmission members.

The bed 3 also carries a beam 12 which constitutes the load-bearing structure for the rear belt 13, the elements of which are supported and guided in exactly the same manner as for the elements of the belt 7, but with the difference that these latter have a shorter length L, as clearly visible in FIGS. 2, 2A, 3 and 3A. At its ends, the beam 12 supports pairs of toothed wheels 15 for driving the rear belt 13 and turning it round. One of said pairs (that shown in FIG. 4) is driven by a vertical shaft 16 connected to the exit of the geared motor 11 by a toothed coupling 17 which enables motion to be transmitted in any position that the beam 12 (and thus the rear belt 13) can assume. A bevel gear 18 is provided on that part of said transmission which is rigid with the belt 13, and transmits motion by way of a bevel gear 19 and chain drive 20 to the exit conveyor 2 (a similar arrangement can be provided for driving the feed conveyor).

In order to enable the height of the beam 12 and thus the relative belt 13 to be adjusted, said belt is slidably mounted on three equidistant tubes 21 fixed at their base to the upper face 22 of a suitable part of the bed 3 and provided with a travel-limiting flange 23 at their upper end. These tubes are surrounded by bronze sleeves 24 rigid with the beam 12. In each of the tubes there is fixed a but screw 25 into which a screw 26 is screwed under the control of reduction gears 27 fixed to the beam 12 and operated by transmission and interconnection rods 28 from a reversable electric motor 29 rigid with one of the reduction hears. It can be seen that when the motor 29 is operated the screws 26 rotate, and because the nut screws 25 are fixed, the beam 12 And relative belt 13 rise and descend in relation to the direction of rotation of the motor 29.

Figure 2:
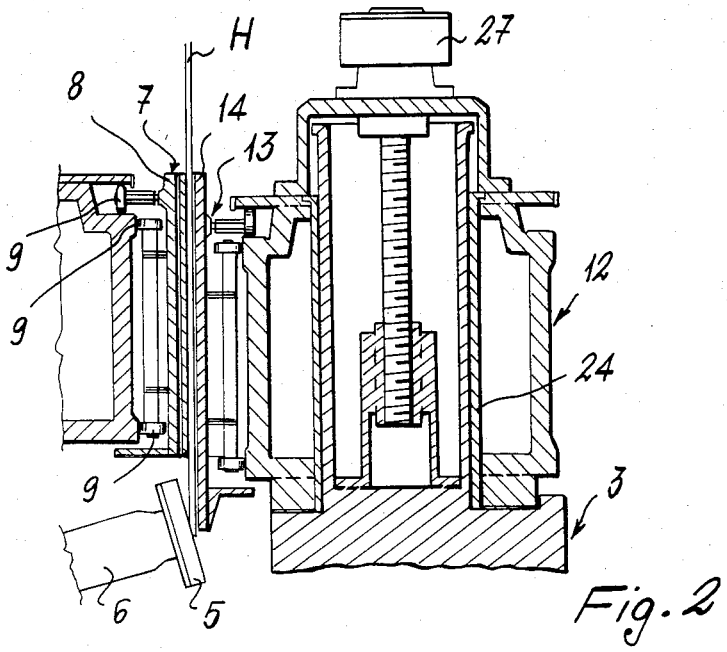
FIGS. 2 and 2A show part of the machine in partial cross-section on the line II—II of FIG. 1, with the rear belt in two different adjustment position.
Figure 2A:
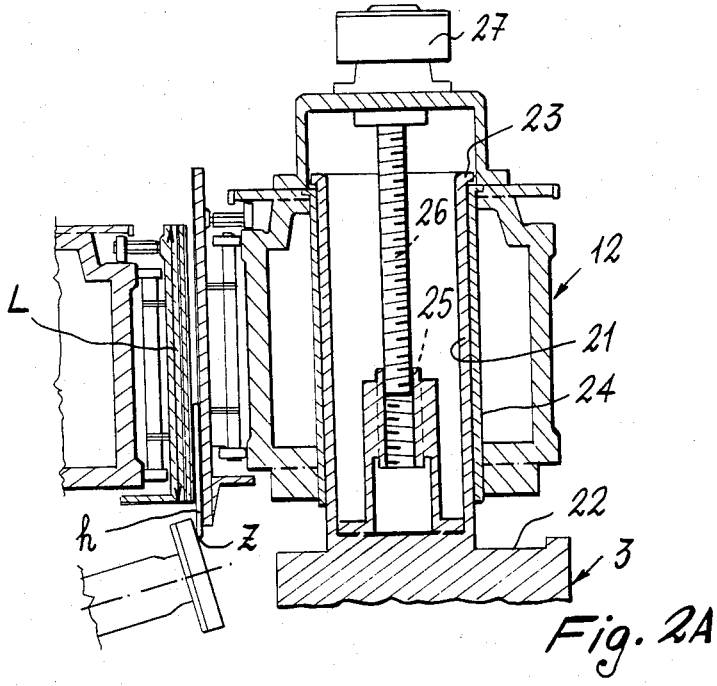

FIGS. 2 and 2A show the maximum lowered position and the maximum raised position of the rear belt 13 respectively. In the position of FIG. 2, the elements 14 of the belt 13 project downwards beyond the lower edge of the elements 8 of the front belt 7 to their maximum extent, and in this position enable large sheets H to be machined, whereas when in the position of FIG. 2 in which the downward projection of the elements 14 is a minimum, very shall sheets h can be machined as they are adequately gripped by the belts.

Figure 3:
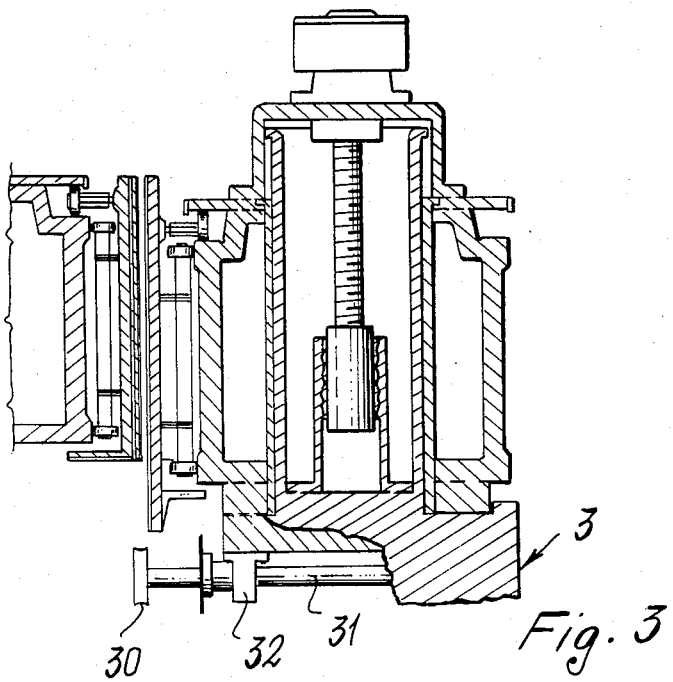
FIGS. 3 and 3A show part of the machine in partial cross-section on the line III—III of FIG. 1, with the rear belt in two different adjustment positions.
Figure 3A:
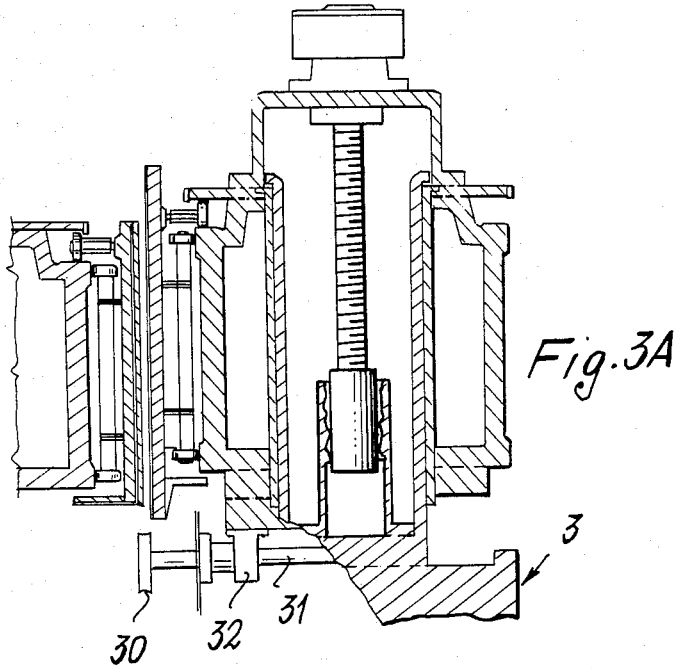
Figure 4:
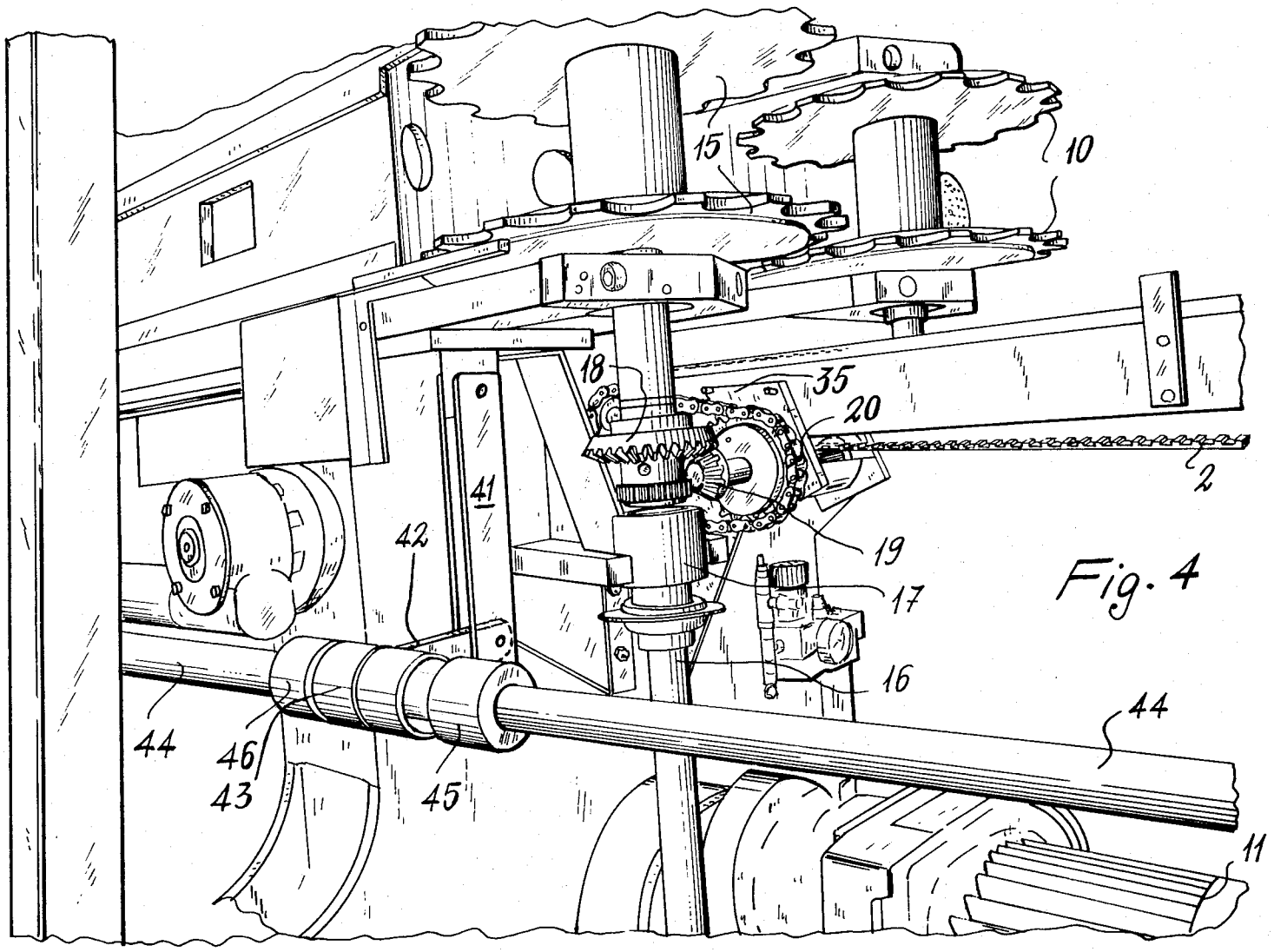
FIG. 4 is a perspective view of the transmission for the rear belt and for the unloading device for the machined sheets.

One of the various tools which are used for machining the sheet is a grinding wheel which finished the lower edge of the sheet, i.e. the lower edge Z thereof. This tool and its drive members cannot be included in the assemblies 4, as the position of this edge varies according to the position assumed by the front belt (as can easily be seen examining FIGS. 2, 2A). The invention provides for this assembly to be supported by the beam 12 of the rear belt 13, as can be seen in FIGS. 3, 3A. In these figures the tool in question, indicated by 30, is fixed at the end of a shaft 31 mounted in support 32 and driven by a geared motor which is not shown but is fixed to the beam 12.

As the position of the sheet between the belts is determined by the upper side of the feed belt 2, the position of this latter must therefore follow the position of the rear belt 13. The same obviously applies to the exit conveyor in order to be able to receive the sheets. For this purpose, one end of the structure supporting the feed belt 2, namely the end close to the machine, is rigid with the beam 12 by way of plates 35. The other end is guided (see FIG. 1) along screw pins 36 provided on an upright 37 (which together with cross members 38 and other uprights forms a structure on which the sheets rest by way of rollers disposed in this structure), through plates 39 provided with long holes 40. In order to raise this outer end of the conveyors 2, the rear beam 12 comprises at each end a pair of articulated parallel arms 41 hinged to a radial arm 42 rigid with a sleeve 43. This sleeve is rigid with transmission rods 44 connected together by articulated joints 45. These rods are mounted in supports 46 fixed to the bench 3 or to the uprights 37. Sleeves 48 are mounted on the rods 44 in proximity to these uprights, and are provided with a radial arm 49 to which there is hinged a connecting rod 50, which itself is hinged to the conveyor 2. By the effect of the described mechanical linkages, the conveyors 2 rise or fall to the same extent as the rear beam 12 and relative belts 13.

In order to vary the height of the rear belt 13 so as to be able to machine sheets of a certain size range, the motor 29 is operated in the required direction and stopped when a reading on a suitable scale confirms that the working position has been attained.

Although only one embodiment of the invention has been described, it will be simple for an expert of the art in possession of the inventive idea to make numerous modifications thereto which lie within the scope of the invention.

Thus, instead of the screw means for raising or lowering the rear belt, jacks can be provided if it is considered sufficient for the belt to assume only two positions.

What I claim is:

1. A chamfering machine for a work piece and particularly for a glass sheet, the machine comprising a front belt and a rear belt each having an upper and lower edge and a vertical or substantially vertical axis for gripping and conveying the glass sheet along a set of tools adapted to machine an edge of the glass sheet, and means for adjusting the height of the rear belt to vary the distance between the lower edges of the front and rear belt respectively so that work pieces of different sizes can be accommodated by the machine.

2. A machine as claimed in claim 1 further comprising a feed and unloading device having a support surface for the glass sheet, the device being operably connected to the rear belt such that the height thereof changes correspondingly as the height of the rear belt is adjusted.

3. The machine as claimed in claim 1 wherein the set of tools includes a grinding wheel for machining the edge of the glass sheet, the grinding wheel being operably connected to the rear belt such that the height thereof changes correspondingly as the height of the rear belt is adjusted.

4. The machine as claimed in claim 1 wherein the means for adjusting the height of the rear belt comprises a beam upon which the rear belt is mounted, stationery tubes on which the beam is slidably supported, a screw member fixed to the beam and rotatable relative to a nut member fixed to the tubes such that rotation of the screw member causes the beam to rise or fall relative to the tubes.

* * * * *